United States Patent [19]

Root et al.

[11] Patent Number: 4,675,121

[45] Date of Patent: Jun. 23, 1987

[54] LUBRICANT COMPOSITIONS

[75] Inventors: Jon C. Root, Leawood; John F. Barnes, Olathe, both of Kans.

[73] Assignee: Witco Corporation, New York, N.Y.

[21] Appl. No.: 876,114

[22] Filed: Jun. 19, 1986

Related U.S. Application Data

[63] Continuation-in-part of Ser. No. 705,239, Feb. 25, 1985.

[51] Int. Cl.[4] ..... C10M 113/08

[52] U.S. Cl. ..... 252/25; 252/18

[58] Field of Search ..... 252/25, 18

[56] References Cited

U.S. PATENT DOCUMENTS

| | | | |
|---|---|---|---|
| 2,533,878 | 12/1950 | Clark | 252/25 |
| 2,780,597 | 2/1957 | Williams et al. | 252/25 |
| 2,988,506 | 6/1961 | Sproule et al. | 252/25 |
| 3,000,819 | 9/1961 | Norton et al. | 252/25 |
| 3,065,176 | 11/1962 | Blake et al. | 252/25 |
| 3,117,085 | 1/1964 | Rees | 252/25 |
| 3,344,065 | 9/1967 | Gänsheimer et al. | 252/25 |
| 3,361,665 | 1/1968 | Tesche et al. | 252/25 |
| 3,464,923 | 9/1969 | Roche | 252/25 |
| 3,907,692 | 9/1975 | Ullmann et al. | 252/25 |
| 4,107,058 | 8/1978 | Clarke et al. | 252/25 |
| 4,305,831 | 12/1981 | Johnson, III et al. | 252/25 |
| 4,444,669 | 4/1984 | Wittse, Jr. et al. | 252/25 |

FOREIGN PATENT DOCUMENTS

| | | | |
|---|---|---|---|
| 774101 | 12/1967 | Canada | 252/25 |
| 139134 | 9/1978 | Fed. Rep. of Germany | 252/25 |

*Primary Examiner*—William R. Dixon, Jr.
*Assistant Examiner*—Cynthia A. Prezlock
*Attorney, Agent, or Firm*—Wallenstein, Wagner, Hattis, Strampel & Aubel, Ltd.

[57] ABSTRACT

Lubricant compositions adapted for use under extreme pressure, high temperature and high speed conditions comprising a major proportion of an oil or grease base material, having a dropping point above about 300° F., and a minor proportion of an additive system containing as an essential component an inorganic phosphate salt, or mixture thereof, in solid form. Preferred salts are alkaline earth metal ortho- or pyrophosphates exemplified by dicalcium phosphate.

10 Claims, No Drawings

LUBRICANT COMPOSITIONS

This application is a continuation-in-part application of application Ser. No. 705,239, filed Feb. 25, 1985.

FIELD OF THE INVENTION

The present invention relates to lubricant compositions, and, in particular, to lubricant compositions adapted for use under extreme pressure, high temperature, and high speed conditions.

BACKGROUND OF THE PRIOR ART

Numerous additives heretofore have been developed for use in the preparation of grease compositions capable of performing under high pressure, high temperature and high speed conditions. Various of these additives include lead-sulfur systems, heavy metal sulfide systems, particularly molybdenum disulfide systems, phosphate salt-oil soluble sulfur, chloride, or carbonate systems, phosphate salt-oil insoluble sulfur, chloride or carbonate systems, and organic phosphate systems, to mention a few. Exemplary of patents directed to such systems are U.S. Pat. Nos. 3,344,065, No. 4,107,058 and No. 4,305,831. While systems of the type mentioned provide some effectiveness under extreme temperature, pressure, and high speed conditions, they have a number of shortcomings, particularly from a material cost standpoint, and, equally importantly, from a toxicity and/or environmentally deleterious standpoint. Thus, by way of illustration, molybdenum disulfide which, perhaps, has been accorded the most general acceptance as an additive for the preparation of extreme pressure lubricants, is comparatively expensive and represents an unfavorable cost factor to manufacturers of such lubricants. Also, with systems employing molybdenum disulfide, or systems which incorporate sulfur compounds other than molybdenum disulfide, there is the possibility of breakdown of such compounds under severe and/or prolonged conditions of use, resulting in the release of sulfur. The sulfur, which may be in a free or combined state, can, in time, cause serious corrosion to metal parts in contact with the lubricant compositions, and, further, may exacerbate handling and disposal of spent lubricant.

BRIEF SUMMARY OF THE INVENTION

In accordance with the present invention, improved extreme pressure lubricant compositions have been provided which, while having properties comparable to those of conventional extreme pressure lubricants, have important cost advantages over such lubricants, and, what is more, are characterized by their low toxicity and their minimal potential for any adverse effects on the environment. In brief, the extreme pressure lubricant compositions of this invention comprise a major proportion of a lubricating base material having a dropping point above about 300° F. and a minor proportion of an additive system consisting essentially of an inorganic phosphate salt, or a mixture of such salts. Apart from the advantages noted above, the extreme pressure lubricant compositions of this invention are characterized in that the dropping point of the starting lubricating base material does not undergo any substantial change after the additive system is incorporated therein. The compositions are also characterized in that they remain stable over prolonged periods of use at the high pressures and elevated temperatures encountered in extreme pressure applications, and, in addition, have load carrying capacities which are at least equal to extreme pressure lubricants incorporating, for instance, molybdenum disulfide as the additive system.

The lubricant compositions of the present invention are to be sharply differentiated from axle or cup greases to which calcium phosphate is added for the purpose of increasing the dropping point of the grease. Axle or cup greases typically have dropping points in the range of 175° F. to about 220° F. German Pat. No. 1,262,227, which corresponds to U.S. Pat. No. 3,361,665, is directed to the preparation of such a grease. More specifically in this connection, the aforementioned German patent discloses the addition of various proportions of calcium phosphate to Stauffer grease. Stauffer grease is an example of an axle or cup grease, and has a dropping point of about 178° F. As taught in the German patent, the addition of 30% by weight of calcium phosphate to Stauffer grease had the effect of increasing the dropping point of the grease to about 242° F. A grease of the type disclosed in the German patent, even at the higher dropping point, is useless for extreme pressure, high temperature and high speed applications, and cannot be compared to the lubricant compositions of the present invention either from the standpoint of the starting materials, or the unique properties of the end product.

DETAILED DESCRIPTION OF THE INVENTION

The inorganic phosphate salts which comprise the additive system of the lubricant compositions of this invention include alkaline earth metal phosphates and alkali metal phosphates. Exemplary of the alkaline earth metal phosphates which can be used are the water insoluble, or difficulty water soluble, ortho-, meta- and pyrophosphates of calcium, magnesium, strontium and barium. The alkali metal phosphates which can be used include the ortho- and pyrophosphates of sodium and potassium. It is important, however, that the presence of water be avoided when employing alkali metal phosphates in the additive systems used in the preparation of the lubricant compositions. Of the foregoing, the ortho-, and pyrophosphates of calcium, namely, mono-, di-, and tri-calcium phosphate and calcium pyrophosphate, are preferred, and of this group, dicalcium phosphate and calcium pyrophosphate are especially preferred.

The inorganic phosphate salts advantageously are utilized in a dry, pulverulent, or powder-like form. Those finely divided phosphates exhibiting a laminar, or platelet or crystalline structure are especially desirable. The particles of the salts can range from submicron in size to about 0.1 to about 75 microns, with a particle size of the order of about 0.2 to about 20, especially desirably about 0.5 to about 16 or 17 microns being preferred. The salts can be added to a lubricant base material in a preformed state, or they can be formed in situ. Combinations of inorganic phosphate salts can be employed if desired.

The lubricant base materials useful in the preparation of the lubricant compositions of this invention can be any of the various greases having dropping points above about 300° F. The generally optimum objectives of the invention are attained with lubricant base materials having dropping points of above about 300° F. to about 650° F., especially lubricant base materials having dropping points of about 450° F. to about 550° F. Illustrative examples of such lubricant base materials are the metal soap-thickened mineral oil base greases such as lithium stearate and lithium hydroxy stearate greases, sodium stearate greases, aluminum hydroxy-benzoate-stearate greases, and the like. Also useful are metal soap-thickened synthetic hydrocarbon oils and synthetic ester oils exemplified by alkyl benzenes, silicone oils, and esters of dibasic acids. In addition, clay based greases such as bentonite and attapulgite grease can be used, as can silica gel greases, barium greases and polyurea greases. Clay based greases have dropping points above about 600° F., usually about 630° F. to about 650° F. Polyurea greases have dropping points in the range of about 450° F. to about 550° F.

The proportion or concentration of the additive system incorporated into the lubricant base material advantageously is about 0.1% to about 75%, preferably about 10% to about 30%, by weight of the total weight of the composition. The concentration of the additive system used is largely dependent upon the use to which a particular lubricant composition is to be put. Thus, for example, if the composition is to be used as a thread lubricant, the lubricant base material may be a polyurea grease having a dropping point of about 450° F., and the concentration of the additive system can be about 50% to about 60%, by weight of the composition. The additive system, as stated, may be formed in the composition in situ, or may be added in a preformed state. Conventional equipment and techniques can be utilized to attain even distribution or dispersion of the additive system in the lubricant base material. In those instances wherein a thickener such as a clay, treated clay, silica, treated silica, a metal soap, or an organic polymer is to be used to form the lubricant compositions of this invention, the additive system may be added to the thickener, and the resulting mixture can be packaged for later use by an extreme pressure lubricant compounder.

In order to impart coloring characteristics to the lubricant compositions of this invention which are comparable to those of conventional extreme pressure greases such as those incorporating molybdenum disulfide, for example, a pigment, or a mixture of pigments, advantageously is added to the compositions. Exemplary of such pigments are ferric oxide, titanium dioxide, and carbon black, and mixtures thereof. The concentration of the pigment used can range from about 0.5% to about 10%, usually about 1% to about 5%, by weight, of the total weight of the additive system.

By way of illustration, and to demonstrate the effectiveness under extreme pressure conditions of the lubricant compositions of this invention, a number of grease based compositions were prepared utilizing different concentrations of an additive system as described hereinabove. The grease base used comprised No. 2 grade lithium hydroxystearate grease composed of both naphthenic and paraffinic oils with a viscosity of 75 SUS @210° F. and 850 SUS @100° F., a dropping point of 379° F. and a viscosity index of 50. The results are shown in Table I.

TABLE I

| COMPOSITION | 4-BALL EXTREME PRESSURE ASTM D-2596 WELD (kg) | LOAD WEAR INDEX | DROPPING POINT DEGREES FAHRENHEIT | 4-BALL WEAR ASTM D-2266 WEAR (mm) | COEFFICIENT OF FRICTION | TIMKEN ASTM D-2509 LOAD (LB.) | COPPER CORROSION ASTM D-130 212° F. |
|---|---|---|---|---|---|---|---|
| 100% Base Grease | 160 | 44.003 | 379 | 0.859 | 0.072 | Failed @ 30 | 1a |
| 99.0% Base Grease 1.0% Dicalcium Phosphate | 200 | 67.041 | 362 | 0.667 | 0.037 | Failed @ 30 | 1a |
| 97.0% Base Grease 3.0% Dicalcium Phosphate | 250 | 75.070 | 358 | 0.667 | 0.045 | OK = 40 | 1a |
| 95.0% Base Grease 5.0% Dicalcium Phosphate | 250 | 79.122 | 349 | 0.571 | 0.044 | OK = 55 | 1a |
| 90.0% Base Grease 10.0% Dicalcium Phosphate | 315 | 109.97 | 332 | 0.430 | 0.036 | OK = 75 | 1a |

Utilizing the same base grease as used in the compositions shown in Table I, a lubricant composition containing 3% by weight of an additive system of the present invention was compared to a conventional extreme pressure grease composition containing 3% by weight of molybdenum disulfide. The results are shown in Table II.

TABLE II

| COMPOSITION | 4-BALL EXTREME PRESSURE ASTM D-2596 WEAR (kg) | LOAD WEAR INDEX | DROPPING POINT DEGREES FAHRENHEIT | 4-BALL WEAR ASTM D-2266 WEAR (mm) | COEFFICCIENT OF FRICTION | TIMKEN ASTM D-2509 LOAD (LB.) |
|---|---|---|---|---|---|---|
| 97% Base Grease 3.0% Molybdenum Disulfide T.F. | 250 | 65.15 | 378 | 0.726 | 0.062 | Failed @ 30 |
| 97.0% Base Grease 3.0% Dicalcium Phosphate | 250 | 75.070 | 358 | 0.667 | 0.045 | OK = 40 |

The data presented in Table II demonstrates the superiority of the extreme pressure lubricant compositions of this invention over conventional extreme pressure lubricants. What is more these results are attained with an additive system which is lower in cost and lower in toxicity than an additive package comprising molybdenum disulfide.

In order to demonstrate the fundamental differences both in materials and function between the lubricant compositions of the present invention and a grease composition as disclosed in German Patent No. 1,262,227, the following comparative test was performed: A lubricant composition was prepared in accordance with the teaching of the present invention by adding a finely divided calcium phosphate to No. 1 grade polyurea grease, having a dropping point of about 500° F.+, to form a lubricant composition comprising about 3% calcium phosphate. The dropping point of the end product was about 500° F+. A grease composition was then prepared in accordance with Example 1 of German Patent No. 1,262,227 by adding the same finely divided calcium phosphate to Stauffer grease (a cup grease), having a dropping point of about 220° F., to form a grease composition comprising approximately 30%, by weight, calcium phosphate. The dropping point of the end product was about 251° F. Samples of each grease composition so prepared were evaluated using ASTM D-3527 "Standard Test Method for Life Performance of Automotive Wheel Bearing Grease". The test was selected because Stauffer grease, and similar cup or axle greases were primarily used for wheel bearings in the past. The highest loading of calcium phosphate in the Stauffer grease disclosed in the German patent was required in order to make the evaluation. The apparatus for conducting the test consisted of a custom made front wheel hub-spindle-bearings assembly encased in an electrically heated, thermostatically controlled oven, a direct-drive d-c motor to drive the hub, accessory equipment to control and monitor motor speed, oven temperature, spindle temperature, time cycles and torque, and a balance having a minimum capacity of 100 grams and minimum sensitivity of 0.1 gram. The test comprised the steps of distributing the grease samples in the bearings of the hub and thrust-loading the bearings to 111 N (unloaded motor current) while rotating the hub at 1000 rpm at a spindle temperature of 320° F. at an operating cycle of 20 hours on and 4 hours off. The test was terminated when grease deterioration caused the drive motor torque to exceed a calculated motor cut off value. Grease life is expressed as the accumulated on-cycle hours.

The grease prepared in accordance with the teaching of German Patent No. 1,262,227 ran only 8.9 hours, that is, less than one cycle, and simply melted away. The polyurea grease prepared in accordance with the teachings of this invention, and containing one-tenth the amount of calcium phosphate present in the grease prepared by the method of said German patent, ran 1300 hours on the same apparatus. The test proved conclusively that Stauffer grease, even at a high loading of calcium phosphate, is totally useless for extreme pressure, high temperature and high speed applications. The test also proved conclusively that the lubricant compositions of the present invention not only are completely different from a grease such as that disclosed in said German patent from the standpoint of the material employed in formulating them, but, also from the standpoint of their ability to meet the demands of extreme pressure, high temperature and high speed applications.

What is claimed is:

1. A lubricant composition for use under extreme pressure, high temperature and high speed conditions, consisting essentially of a major proportion of a lubricant base material having a dropping point above about 300° F., and a minor proportion of an additive system consisting essentially of an inorganic phosphate salt in particle form selected from the group consisting of water-insoluble or difficultly water-soluble mono-, di-, and tri-calcium phosphate and calcium pyrophosphate, and compatible mixtures thereof, the particle size of said salt ranging in size from submicron to about 75 microns, said additive system being present in an amount sufficient to impart extreme pressure, high temperature and high speed tolerance properties to the lubricant base material while having no substantial affect on the dropping point of the lubricant base material.

2. A lubricant composition according to claim 1 wherein the additive system comprises about 0.1°% to about 75% by weight of the lubricant composition.

3. A lubricant composition according to claim 1 wherein the additive system is dicalcium phosphate.

4. A lubricant composition according to claim 1 wherein the lubricant base material is selected from the group consisting of lithium base greases, aluminum complex base greases, calcium complex base greases, barium greases, polyurea greases and clay based greases.

5. A lubricant composition according to claim 1 wherein the additive system is carried in a vehicle comprising a grease thickener in the form of a clay, treated clay, silica or treated silica.

6. A lubricant composition according to claim 1 wherein the lubricant base material and the additive system are essentially water-free.

7. A lubricant composition according to claim 1 wherein the lubricant base material has a dropping point of above about 300° F. to about 650° F.

8. A lubricant composition according to claim 1 wherein the lubricant base material is a polyurea grease having a dropping point of about 450° F. to about 550° F.

9. A lubricant composition according to claim 1 wherein the particle size of the inorganic phosphate salt is about 0.2 micron to about 20 microns.

10. A lubricant composition according to claim 1 wherein the additive system comprises an inorganic phosphate salt formed in situ in the lubricant base material.

* * * * *